US009044982B2

(12) United States Patent
Ikeda et al.

(10) Patent No.: US 9,044,982 B2
(45) **Date of Patent: *Jun. 2, 2015**

(54) COOLING DEVICE AND IMAGE FORMING APPARATUS

(71) Applicants: Keisuke Ikeda, Fujisawa (JP); Tomoyasu Hirasawa, Yokohama (JP); Kenichi Takehara, Sagamihara (JP); Hiromitsu Fujiya, Kawasaki (JP); Keisuke Yuasa, Ebina (JP)

(72) Inventors: Keisuke Ikeda, Fujisawa (JP); Tomoyasu Hirasawa, Yokohama (JP); Kenichi Takehara, Sagamihara (JP); Hiromitsu Fujiya, Kawasaki (JP); Keisuke Yuasa, Ebina (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

This patent is subject to a terminal disclaimer.

(21) Appl. No.: 13/958,014

(22) Filed: Aug. 2, 2013

(65) Prior Publication Data

US 2014/0060782 A1 Mar. 6, 2014

(30) Foreign Application Priority Data

Aug. 10, 2012 (JP) ..... 2012-178305

(51) Int. Cl.

| | |
|---|---|
| ***G03B 21/20*** | (2006.01) |
| ***B41J 29/377*** | (2006.01) |
| ***B41J 11/00*** | (2006.01) |
| ***G03G 15/00*** | (2006.01) |

(52) U.S. Cl.

CPC ..... *B41J 29/377* (2013.01); *B41J 11/007* (2013.01); *G03G 15/6573* (2013.01)

(58) Field of Classification Search

USPC ..... 399/94

See application file for complete search history.

(56) References Cited

U.S. PATENT DOCUMENTS

| | | | | |
|---|---|---|---|---|
| 2004/0076456 | A1* | 4/2004 | Tani et al. | 399/329 |
| 2009/0103959 | A1* | 4/2009 | Koyama et al. | 399/341 |
| 2010/0021194 | A1* | 1/2010 | Toyohara et al. | 399/69 |
| 2012/0315069 | A1* | 12/2012 | Ikeda et al. | 399/341 |
| 2013/0121739 | A1* | 5/2013 | Hatazaki | 399/341 |
| 2013/0177332 | A1* | 7/2013 | Saito | 399/92 |
| 2014/0016975 | A1* | 1/2014 | Shimada et al. | 399/341 |

FOREIGN PATENT DOCUMENTS

| | | |
|---|---|---|
| JP | 2004-279542 | 10/2004 |
| JP | 2012-098677 | 5/2012 |
| JP | 2012-167844 | 9/2012 |
| JP | 2012-168216 | 9/2012 |
| JP | 2012-173640 | 9/2012 |

OTHER PUBLICATIONS

U.S. Appl. No. 14/140,888, filed Dec. 29, 2013, Hirasawa et al.

* cited by examiner

*Primary Examiner* — Rodney Fuller

(74) *Attorney, Agent, or Firm* — Oblon, McClelland, Maier & Neustadt, L.L.P.

(57) ABSTRACT

A cooling device includes a rotatable belt extended by a plurality of extending members that transfers a sheet in contact with the surface of the belt, and a plurality of cooling members to cool the sheet via the belt. A cooling surface of the cooling members contacts an internal surface of the transport belt. The cooling members are detachable. The cooling device also includes an adjuster to adjust a contact condition between the cooling surface and the internal surface according to the number of cooling members installed.

20 Claims, 14 Drawing Sheets

COOLING DEVICE AND IMAGE FORMING APPARATUS

CROSS-REFERENCE TO RELATED APPLICATIONS

This patent specification is based on and claims priority from Japanese Patent Application No. 2012-178305, filed on Aug. 10, 2012 in the Japan Patent Office, the contents of which are hereby incorporated by reference herein in their entirety.

BACKGROUND OF THE INVENTION

1. Field of the Invention

The present invention generally relates to a cooling device used in a printer, a facsimile machine, a copy machine or the like, and an image forming apparatus including the cooling device.

2. Discussion of the Background Art

One type of image forming apparatus is known in which an electrophotographic technology is used for forming a toner image on a recording material.

Japanese Patent No. 4114864 discloses a cooling device including a pair of transport belts to transfer a sheet, and a cooling surface of a cooling member contacts an internal surface of the transport belts. When the sheet, which is conveyed to the transport belts, passes an area facing the cooling member, the sheet is cooled as heat is removed from the sheet via the transport belt. This process also reduces adherence of a toner that is softened by a fixing device to the transport belts or a transport roller.

In addition, cooling the sheet by a cooling device, can reduce passing the softened toner (so-called "blocking phenomenon") between stacked sheets at the eject tray.

For fully cooling thick paper, which has a heat capacity that is large and does not cool easily according to high productivity of the image forming apparatus, the cooling device requires a plurality of cooling members. Therefore, the cooling device is expensive. In particular, for users to use only thin paper or standard thickness paper, which has a thermal capacity that is small and is easy to cool, the cooling device including the plurality of cooling devices, as mentioned above, is unnecessary. In addition, the user contributes to a waste of cost. Therefore, when a user who does not print the thick paper, uses an image forming apparatus which has a minimal number of cooling members rather than that of the image forming apparatus for the thick paper, it is possible to prevent unnecessary high costs.

However, when a user, who prints only thin paper or standard thickness paper, needs to print a thick paper, the user needs to buy the image forming apparatus including the cooling device for thick paper. Therefore, the user pays the cost of the other image forming apparatus.

SUMMARY OF THE INVENTION

In accordance with an embodiment of the present invention, disclosed herein is a cooling device including a rotatable belt extended by a plurality of extending members, that conveys a sheet in contact with a surface of the belt, a plurality of cooling members to cool the sheet via the belt, where a cooling surface of each cooling member contacts an internal surface of the belt, and where the cooling member is detachable, and an adjuster to adjust a contact condition of the cooling surface and the internal surface according to the number of cooling members installed.

BRIEF DESCRIPTION OF THE DRAWINGS

A more complete appreciation of the disclosure and many of the attendant advantages thereof will be readily obtained as the same becomes better understood by reference to the following detailed description when considered in connection with the accompanying drawings, wherein.

DETAILED DESCRIPTION OF PREFERRED EMBODIMENTS

Figure 1:
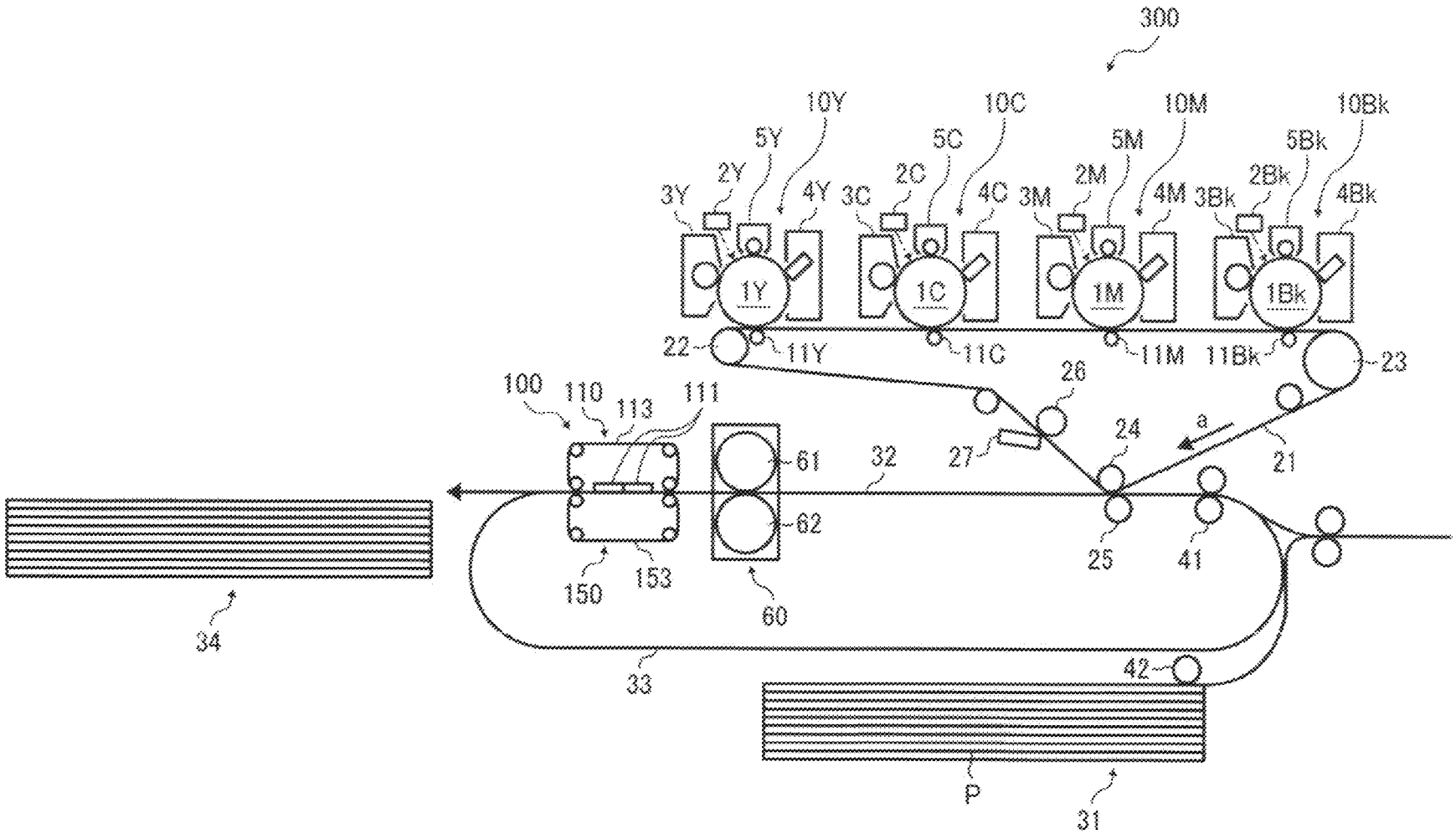
FIG. 1 is a schematic view of a printer according to an illustrative embodiment of the present invention.

In describing preferred embodiments illustrated in the drawings, specific terminology is employed for the sake of clarity. However, the disclosure of this patent specification is not intended to be limited to the specific terminology so selected, and it is to be understood that each specific element includes all technical equivalents that operate in a similar manner and achieve a similar result.

In the following, examples of an embodiment of the present invention, which exemplify a cooling device in a printer as an image forming apparatus, will be described.

FIG. 1 is a general configuration diagram of the printer 300 as an image forming apparatus according to the present embodiment.

The printer 300 has an intermediate transfer belt 21 wrapped and stretched around multiple rollers (a first belt extending roller 22, a second belt extending roller 23, a third belt extending roller 24 and the like). The intermediate transfer belt 21 rotates in the direction designated by an arrow "a" in FIG. 1, driven by a rotational movement of one of the rollers 22-24.

The printer 300 also has image-forming process sections disposed around the intermediate transfer belt 21. Here, suffixes after numeral codes, Y, C, M, and Bk, stand for yellow, cyan, magenta, and black, respectively, to clarify for which of the colors a part is used.

Above the intermediate transfer belt 21 rotating in the direction designated by an arrow "a" in FIG. 1, and between the first belt extending roller 22 and the second belt extending roller 23, image stations 10(Y, C, M, Bk) for the colors are disposed as the image-forming process sections.

These are arranged in order of the image station 10Y, the image station 10C, the image station 10M, and the image station 10Bk in the moving direction of the intermediate transfer belt 21. All the four image stations 10(Y, C, M, Bk) have substantially the same configuration except for the color of toner. Each of the image stations 10(Y, C, M, Bk) includes a drum-shaped photoconductor 1, around which a charging device 5, an optical writing device 2, a developing device 3, and a photoconductor cleaning device 4 are arranged.

At a position opposite of the photoconductor 1 across the intermediate transfer belt 21, a primary transfer roller 11 is provided for transferring an image onto the intermediate transfer belt 21.

These four image stations 10 (Y, C, M, Bk) are arranged in the moving direction of the intermediate transfer belt 21 with predetermined intervals.

The printer 300 has an optical system having an LED as a light source. Alternatively, a semiconductor laser may be used as a light source in the optical system. With either light source, each of the photoconductors 1 is exposed to light according to image information.

Below the intermediate transfer belt 21, there are a sheet holder 31 to hold the sheet P, the sheet conveying roller 42, and the pair of resist rollers 41.

At a position opposite of the third belt extending roller 24 extending the intermediate transfer belt 21, the secondary transfer roller 25 is disposed for transferring a toner image onto the sheet P from the intermediate transfer belt 21.

In addition, a belt cleaning device 27 is disposed at a position downstream in the moving direction of the intermediate transfer belt 21 relative to the extending roller 24, and at a position upstream in the moving direction of the intermediate transfer belt 21 relative to the extending roller 22.

The cleaner supporting roller 26 contacts the internal surface of the intermediate transfer belt 21, whereas the belt cleaning device 27 contacts the external surface of the intermediate transfer belt 21.

A sheet transport passage 32 is extended from the sheet holder 31 to an ejected sheet holder 34. On the way along the sheet transport passage 32, a fixing device 60 is disposed at a position downstream in the sheet transport direction relative to the secondary transfer roller 25.

The fixing device 60 includes a heat applying roller 62 and a pressure applying roller 61. At a downstream position relative to the fixing device 15 along the sheet transport passage 32, a cooling device 100 is disposed for cooling a sheet P having toner fixed thereon. Further downstream from the cooling device 100, the ejected sheet holder 34 is disposed for ejecting the sheet P having toner fixed thereon.

Below the sheet transport passage 32, a reversed-sheet-transport passage 33 is provided for forming an image on the reverse side of the sheet P for double-side printing, which flips the sides of the sheet P that has passed through the cooling device 100 once, and conveys the sheet P to the pair of resist rollers 41 again.

An image forming process at an image station 10 proceeds as follows. The process involves a general electrostatic recording method in which the photoconductor 1 is uniformly charged by the charging device 5, which is exposed to light in the dark to form an electrostatic latent image by the optical writing device 2.

The electrostatic latent image is visualized as a toner image by the developing device 3, which is transferred from the photoconductor 1 to the intermediate transfer belt 21 by the primary transfer roller 11. The photoconductor cleaning device 4 cleans the surface of the photoconductor 1 after the transfer.

The above image forming process is executed at all of the image stations 10 (Y, C, M, Bk).

The developing devices 3 (Y, C, M, Bk) of the four image stations 10 (Y, C, M, Bk) have a visualizing function for toner of the four different colors including yellow, cyan, magenta, and black to form a full-color image. Each of the image stations 10 includes the photoconductor 1 and the primary transfer roller 11 located opposite to the photoconductor 1 across the intermediate transfer belt 21. A transfer bias is applied to the primary transfer roller 11. These parts configure a primary transfer section.

With the configuration above, an image forming area of the intermediate transfer belt 21 passes through the four image stations 10 (Y, C, M, Bk).

While passing through the four image stations 10 (Y, C, M, Bk), different color toner images are superposed one by one on the intermediate transfer belt 21 with the transfer bias applied to the primary transfer roller 11. Thus, a full-color toner image can be obtained on the image forming area by the superposed transfer, once the image forming area has passed through the primary transfer sections of the image stations 10 (Y, C, M, Bk).

The full-color toner image on the intermediate transfer belt 21 is then transferred to the sheet P. After the transfer, the intermediate transfer belt 21 is cleaned by the belt cleaning device 27. The transfer of the full-color toner image from the intermediate transfer belt 21 to the sheet P is executed as follows.

A transfer bias is applied to the secondary transfer roller 25 to form a transfer electric field between the secondary transfer roller 25 and the third belt extending roller 24 across the intermediate transfer belt 21, through which the sheet P passes a nip between the secondary transfer roller 25 and the intermediate transfer belt 21.

After transferring of the full-color toner image from the intermediate transfer belt 21 to the sheet P, heat and pressure is applied to the full-color toner image borne on the sheet P at the fixing device 15 to fix the image on the sheet P to form the final full-color image on the sheet P.

After that, the sheet P is cooled by the cooling device 100 before being stacked on the ejected sheet holder 34. Therefore, after cooling, the sheet P is stacked on the ejected sheet holder 34.

The temperature of the fixing device 15 is dependent upon the sheet transport speed, the type of toner, and the type of the sheet P. For example, a controller controls the temperature to be around 180-200 degrees Celsius. Then the fixing device 15 melts the toner on the paper instantly. Immediately after the sheet P passes through the fixing device 15, the surface temperature of the sheet P reaches around 100-130 degrees Celsius. The surface temperature depends on the thermal capacity (specific heat, density) of the paper.

The melting temperature of the toner is lower than 100 degrees Celsius. Therefore, immediately after the sheet P passes through the fixing device 15, the toner on the surface of the sheet P is still soft. Therefore, the toner on the surface of the sheet P is adhered until the sheet P cools.

Therefore, when the printer 300 forms an image on a plurality of sheets P continually, and ejects onto the sheet holder 34 the plurality of the sheets P having toner fixed thereon, the softened toner on one sheet P might pass to an adjacent sheet P (so-called "blocking phenomenon").

Therefore, as the cooling device 100 cools the sheet P passing through the fixing device 15, the toner on the sheet P is securely hardened to avoid the blocking phenomenon at the point in time that the sheet P is stacked on the sheet holder 34.

Figure 2:
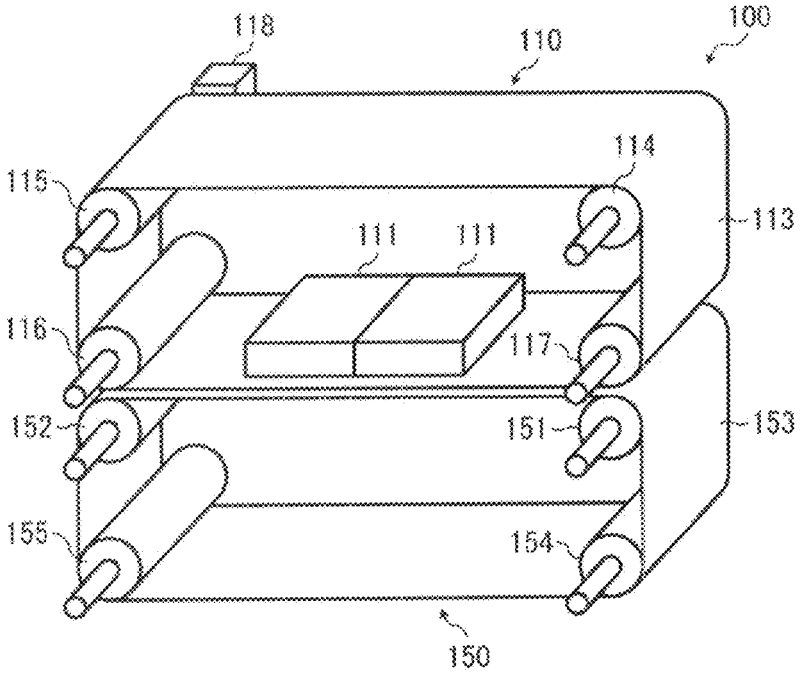
FIG. 2 is a perspective view of a cooling device.

FIG. 2 shows the cooling device 100 of the embodiment including the sheet transport device having the upper transport portion 110 and the lower transport portion 150.

The upper transport portion 110 includes an upper transport belt 113, which is wrapped around and stretched by the extending rollers (114,115,116,117), to convey the sheet P in contact with the surface of the upper transport belt 113. The extending roller 115 is a drive roller that is rotated by a driving force transmitted from a drive motor 118. The extending rollers (114,116,117) are driven rollers rotated with the rotation of the upper transport belt 113. Then, with rotation in a clockwise direction by the extending roller 115, the upper transport belt 113 rotates in a clockwise direction.

On the inside of the loop of the upper transport belt 113, the cooling member 111 is disposed in contact with the back surface of the upper transport belt 113 and cools the sheet P held on the surface of the upper transport belt 113.

The lower transport portion 150 includes the lower transport belt 153, which is wrapped around and stretched rotatably on the extending rollers (151,152,154,155). The lower transport belt 153 contacts the upper transport belt 113 directly or through the sheet P. The lower transport belt 153 rotates in the counterclockwise direction by the rotation of the upper transport belt 113.

The upper transport belt 113 and the lower transport belt 153 convey the sheet P, on which heat and pressure are applied at the fixing device 15 to fix the image. When the sheet P, conveyed by the upper transport belt 113 and the lower transport belt 153, reaches the position of the opposite region to the cooling member 111, the heat of the sheet P is transferred to the cooling member 111 via the upper transport belt 113. Therefore, the cooling member 111 and the transport belt 113 are capable of conveying and cooling the sheet P including fixed toner to the ejected sheet holder 34.

Figure 3:
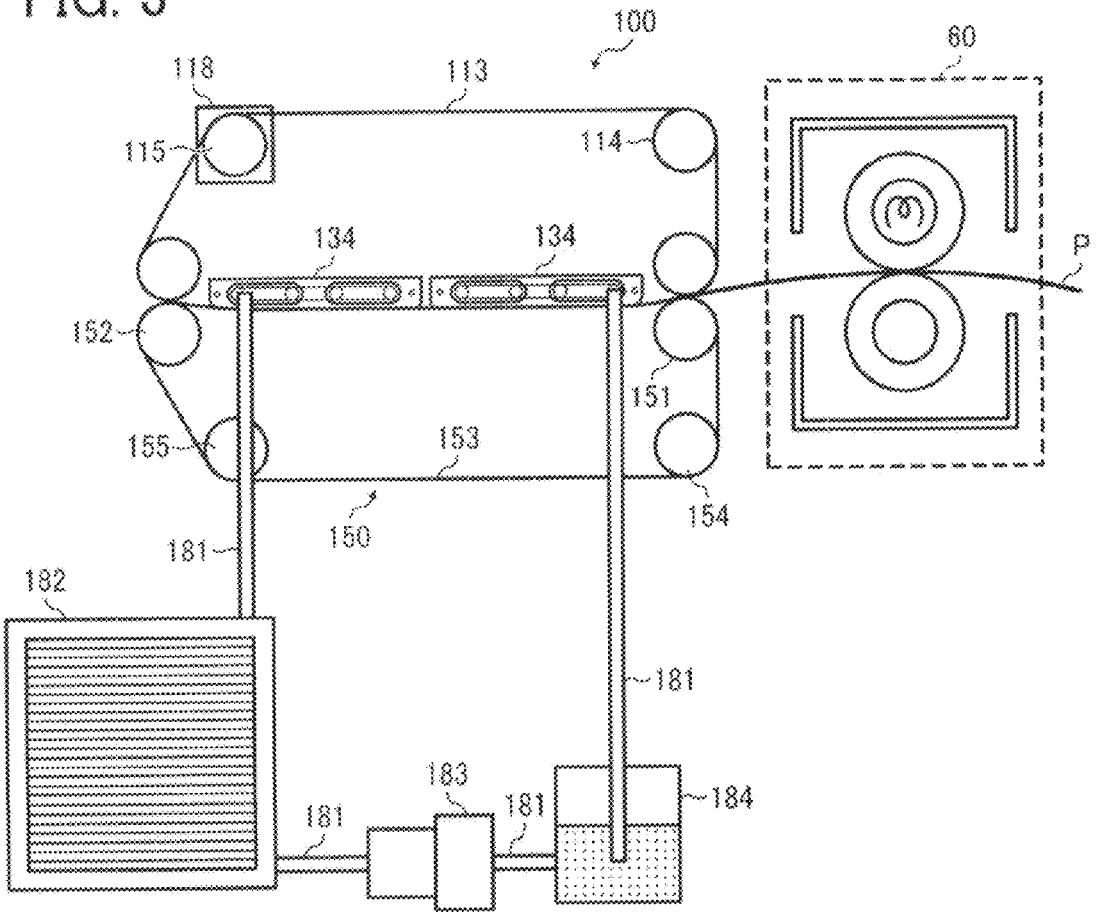
FIG. 3 is a schematic view of a liquid-cooling system of a cooling device.

As shown in FIG. 3, the cooling device 100 is a liquid-cooling system and includes the cooling member 111, which is disposed on the inside surface of the upper transport belt 113 at the upper transport portion 110. The cooling device 100 further includes a flow path internally to flow the cooling liquid.

The cooling device 100 of the embodiment of the present invention provides higher cooling efficiency than other cooling devices that use an air-cooling system.

And more specifically, the cooling member 111 includes a liquid cooling plate made of aluminum and having a liquid flow path 185 therein. See FIGS. 15A-17B. The side of one end of the belt width direction of the cooling member 111 forms an outlet and an inlet connected to the rubber tube 181 as a conveyance pipe. The radiator 182, the liquid conveying pump 183, and the liquid storing tank 184 connect to the rubber tube 181.

A liquid coolant is in a low-temperature state by passing from the liquid storing tank 184 to the radiator 182 using the liquid conveying pump 183. The liquid coolant in the low-temperature state returns to the liquid storing tank 184 via the liquid flow path 185 formed inside of the cooling member 111, as the cooling member 111 transfers the heat of the sheet P. A current of air inside the printer 300 or air of a natural convection passes between the plurality of cooling fins, which includes the liquid flow path, and the radiator 182 radiates the heat of the liquid coolant. According to an embodiment of the present invention, the cooling fan blows the radiator 182 to enhance a heat radiation effect and the cooling effect by the cooling member 111.

As shown in FIG. 3, the radiator 182, the liquid conveying pump 183, and the liquid storing tank 184 are located in front of the cooling member 111, but the present invention is not limited to this embodiment. The radiator 182, the liquid conveying pump 183, and the liquid storing tank 184 can be located at any position of the printer 300, so long as the rubber tube 181 does not bend and warp, or so long as a liquid conveying path does not become extremely long. According to any position, the radiator 182 can be located at any position of the printer 300 apart from the cooling member 111. Therefore, the flexibility of the design of the cooling device increases and permits a reduction in the size of the printer 300. In addition, for example, locating the radiator 182 near the radiator fan that is installed in the housing of the printer 300 or near the other radiator fan, can cut the cost and space of each of the cooling fans.

In the case where the liquid flow path 185 inside of the cooling member 111 is made of a dissimilar metal, such as aluminum and copper, galvanic corrosion may occur and make a hole in a side of the less-noble-metal (aluminum). Therefore, to the utmost, it is recommended that the liquid flow path 185 inside of the cooling member 111 is made of the same metal.

Configuration Example 1

Figure 4:
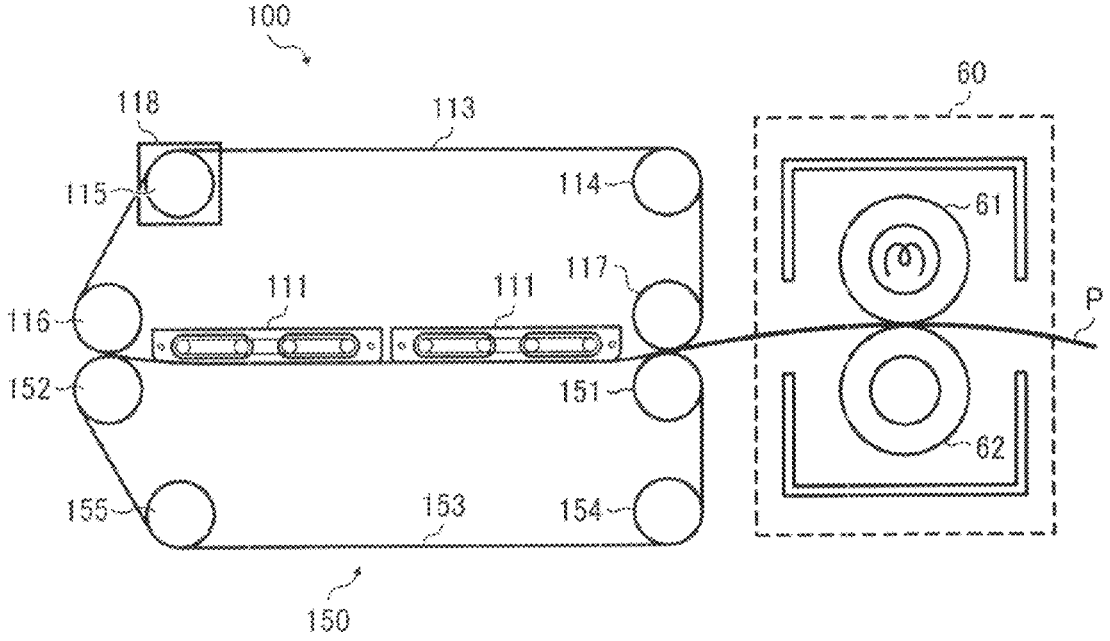
FIG. 4 illustrates a cooling device equipped with two cooling members, the cooling device can be installed with a maximum of two cooling members.
Figure 5:
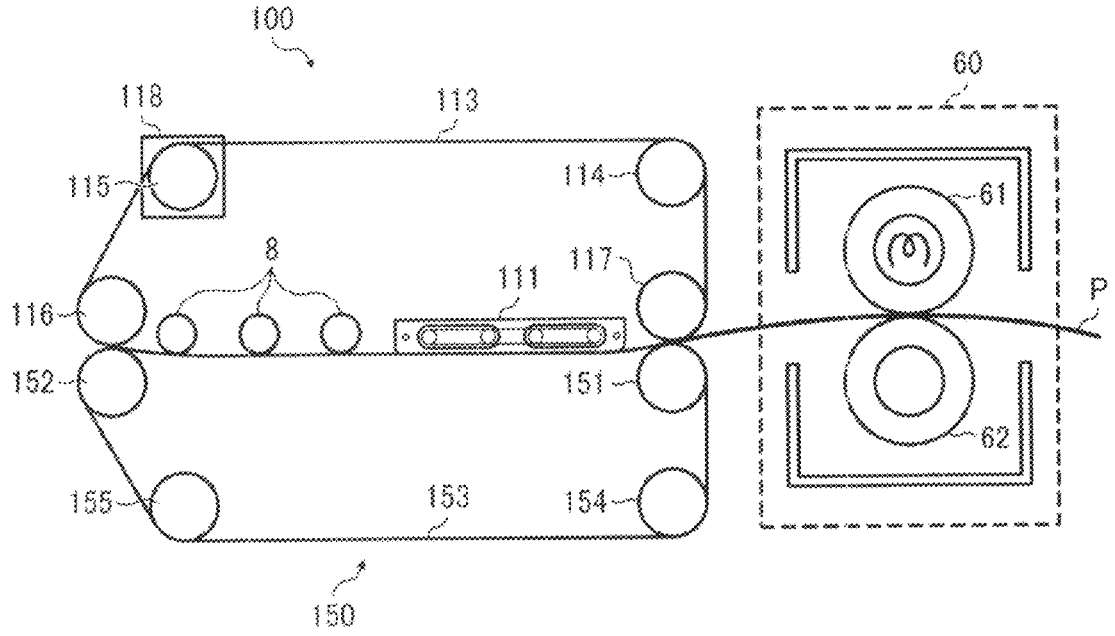
FIG. 5 illustrates a cooling device equipped with two cooling members, the cooling device can be installed with a maximum of two cooling members.

According to configuration example 1, the cooling member 111 is removable from the cooling device main body. FIG. 4 shows a cooling device equipped with two cooling members 111 for users to print a large number of thick paper sheets having a large thermal capacity and which is difficult to cool. Meanwhile, FIG. 5 shows a cooling device equipped with the cooling member 111 for users to use only thin paper or plane paper having a smaller thermal capacity and which is easy to cool. Thus, it is possible to prevent higher costs by only providing sufficient equipment for the desired performance.

In addition, if the print volume or the type of paper has changed, a user can simply add another cooling member 111.

FIG. 4 and FIG. 5 show a cooling device that accommodates a maximum of two cooling members 111, but the maximum number of cooling members 111 may be arbitrary.

In order to generate a uniform contact pressure between the cooling surface of the cooling member 111 and the upper transport belt 113, it is preferable to have a curved shape for the cooling surface of the cooling member 111.

Figure 6:
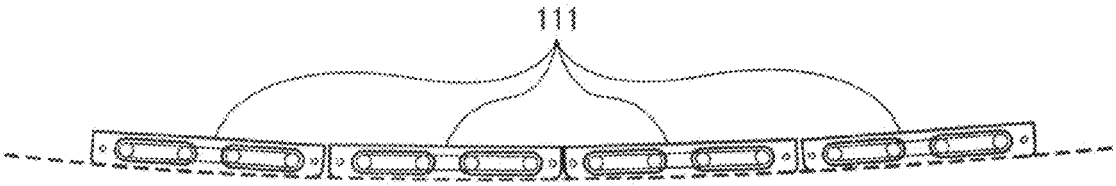
FIG. 6 illustrates the cooling members disposed in an internal surface of an upper transport belt, and each surface of the cooling members constitutes a consecutive curved surface.

In FIG. 6, a plurality of cooling members 111 are installed on an inside surface of the upper transport belt 113. As shown in broken lines in FIG. 6, the cooling surface of each cooling member 111 is arranged on a continuous and smooth curved surface. In order to arrange and produce the same shape of the plurality of cooling members 111, it is preferred that the cooling surface is a cylindrical shape. However, it may also be other shapes.

Figure 7:
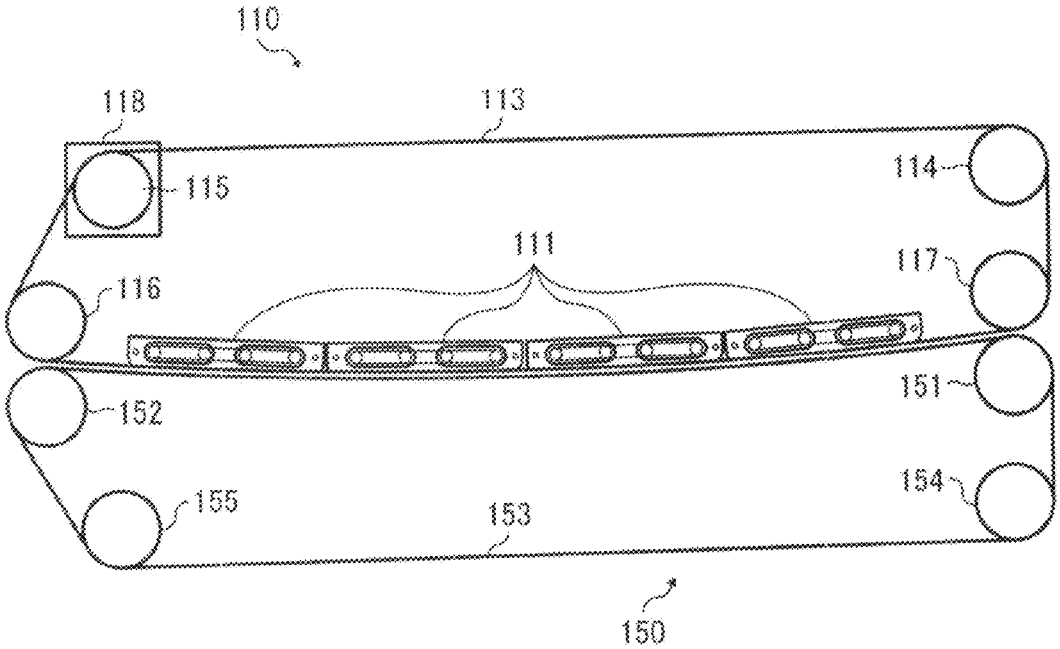
FIG. 7 illustrates a cooling device equipped with four cooling members, the cooling device can be installed with a maximum of four cooling members.

FIG. 7 shows an example of the cooling device 100 that accommodates a maximum of four cooling members 111.

Figure 8:
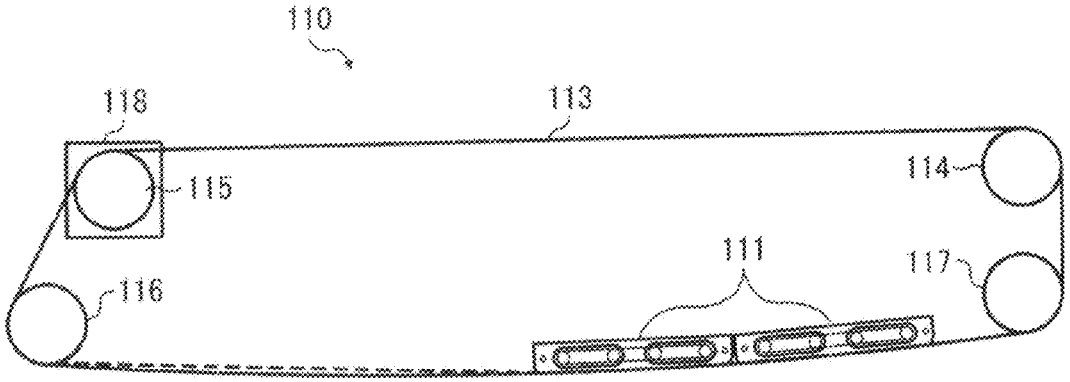
FIG. 8 illustrates a cooling device equipped with two cooling members, the cooling device can be installed with a maximum of four cooling members.

The cooling device 100 that includes two cooling members 111 is discussed as follows. FIG. 8 shows a cooling device, around the upper transport belt 113, equipped with two cooling members 111 in the cooling device that accommodates a maximum of four cooling members 111. Detaching two cooling members 111 from the cooling device, the upper transport belt 113 is slack. Broken line shows the shape of the upper transport belt 113 when the upper transport belt 113 has sufficient tension. The difference between the broken line and a continuous line drawn to depict the shape of the upper transport belt 113 depicts slack in the upper transport belt 113. When the slack occurs in this way, the cooling member 111 does not fit the upper transport belt 113. Hence, the cooling efficiency by thermal contact conductance decreases. Therefore, it is necessary to adjust the tension of the upper transport belt 113 for fitting the cooling members 111 in the upper transport belt 113.

Figure 9:
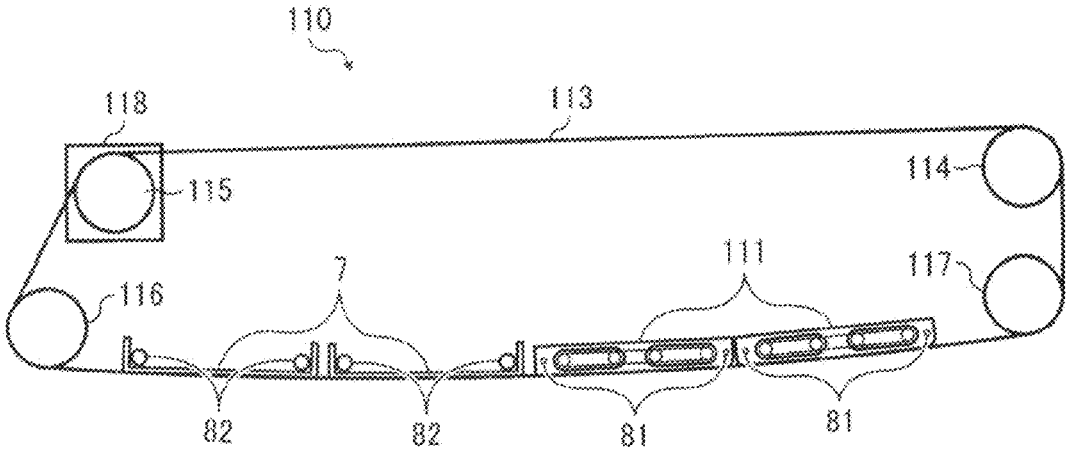
FIG. 9 is a schematic view of the cooling device attached to an auxiliary member instead of the cooling member.
Figure 10A:
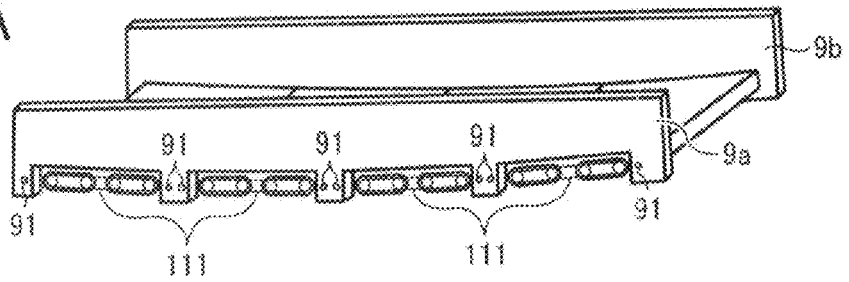
FIG. 10A is a process drawing of the attaching and detaching procedure of the cooling member and the auxiliary member to a side plate.
Figure 10B:
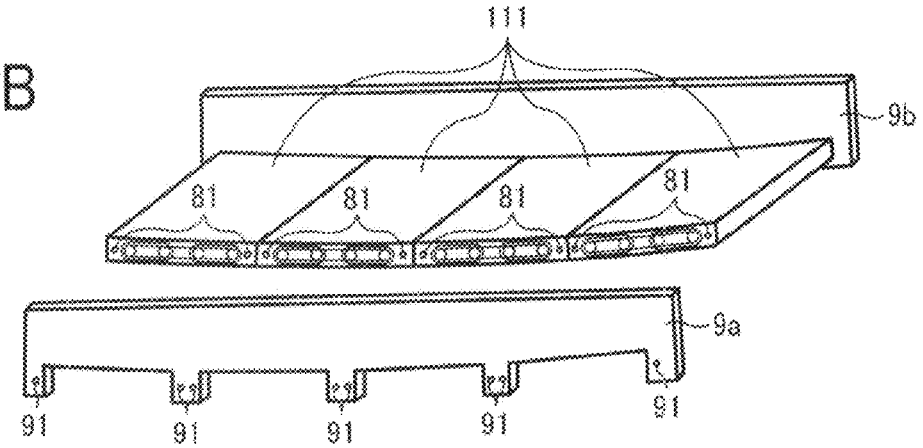
FIG. 10B is a process drawing of the attaching and detaching procedure of the cooling member and the auxiliary member to a side plate.
Figure 10C:
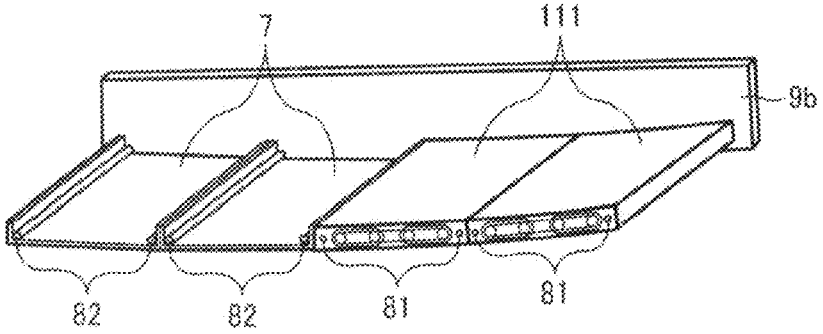
FIG. 10C is a process drawing of the attaching and detaching procedure of the cooling member and the auxiliary member to a side plate.
Figure 10D:
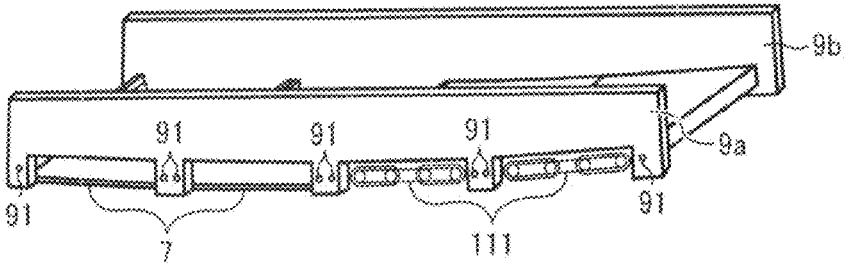
FIG. 10D is a process drawing of the attaching and detaching procedure of the cooling member and the auxiliary member to a side plate.
Figure 11A:
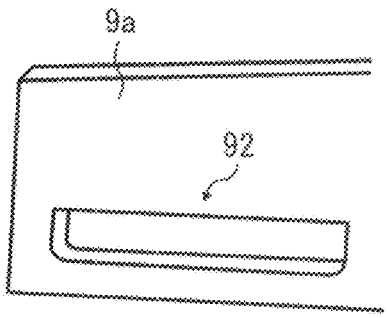
FIG. 11A is an enlarged perspective view around the opening of the side plate.
Figure 11B:
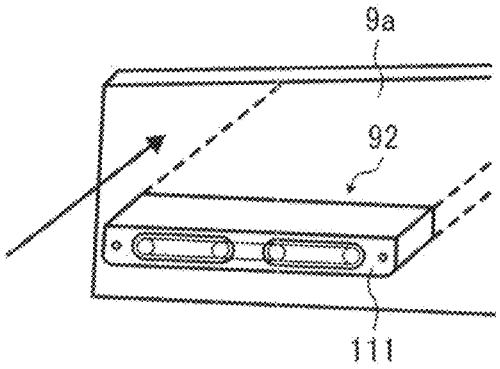
FIG. 11B is an enlarged perspective view of the cooling member or the auxiliary member attached to the opening of the side plate.

FIGS. 9-11 show an adjuster to adjust the tension of the upper transport belt 113, when the number of cooling members 111 inside the cooling device 100 is changed.

To adjust slack in the upper transport belt 113, the cooling device 100 includes one or more auxiliary members 7 instead of a cooling member 111, as shown in FIG. 9. The auxiliary members 7 have the same shape as the cooling surface of the cooling member 111 and are cheaper than the cooling member 111. Hereby, tension of the upper transport belt 113 including the auxiliary member(s) 7 is the same tension as if a maximum number of the cooling members 111 were installed inside the cooling device 100.

As shown in FIG. 10A, the cooling members 111 are sandwiched between the side plates 9*a* and 9*b*, and fixed by a pin, a screw, or both as a fixed member in the insert holes 91 that are formed in the side plates 9*a* and 9*b*. The insert holes 91 are formed to fix the cooling members 111 to the appropriate position. Also, the cooling members 111 and the auxiliary members 7 include the fastening holes 81 and 82, respectively, that coincide with the insert holes 91 to be fixed by pin or screw or both. When removing the side plate 9*a* of the operator side as shown FIG. 10B, it is possible to install and interchange the cooling member 111 and the auxiliary member 7, as shown FIG. 10C. After interchanging the cooling member 111 and the auxiliary member 7, the side plate 9*a* of the operator side is pinned as a fixed member. Therefore, the cooling member 111 and the auxiliary member 7 are fixed and sandwiched between the side plate 9*a* and 9*b* as shown in FIG. 10D.

The outer border of the cooling member 111 and the auxiliary member 7 correspond in shape. As shown in FIG. 11, the side plate 9*a* includes an opening 92 that has a shape like the outer border of the cooling member 111 and the auxiliary member 7. The cooling member 111 and the auxiliary member 7 may be embedded in the opening 92.

For fixing the cooling member 111 and the auxiliary member 7 to the appropriate position toward the side plate 9*a*, the positioning means of the side plate 9*a* may not form same shape as the outer border of the opening 92. For example, the side plate 9*a* may include a convex portion on which hangs the cooling member 111 and the auxiliary member 7.

Configuration Example 2

Figure 12:
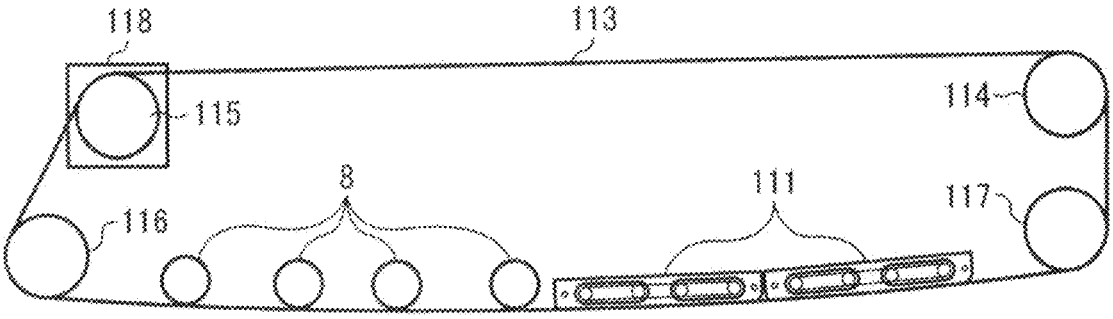
FIG. 12 is a schematic view of the cooling device attached to the plurality of the auxiliary members instead of the cooling member.

According to configuration example 2, a plurality of the auxiliary rollers 8 for adjusting tension of the upper transport belt 11 are installed at a position of the cooling surface where adjacent the cooling members 111 on the inside of the cooling device 100, as shown in FIG. 12. The auxiliary rollers 8 make the tension of the upper transport belt 113 nearly the same as the tension with the maximum of two cooling members 111.

When the auxiliary roller 8 is installed on the upper transport belt 113 as shown in FIG. 12, there is less abrasion than when the auxiliary member 7, as shown in FIG. 9 is installed. Therefore, the auxiliary member 8 prevents the upper transport belt 113 from sliding.

Configuration Example 3

Figure 13:
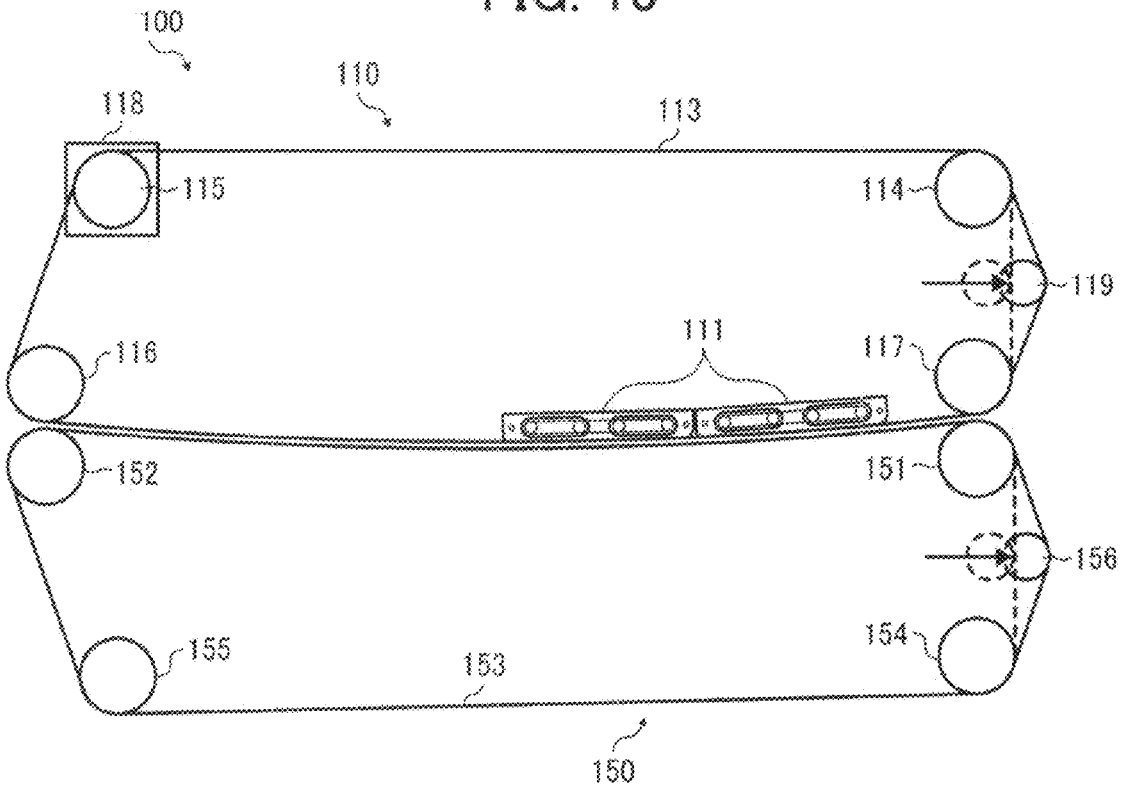
FIG. 13 is a schematic view of the cooling device including a changeable extending roller.
Figure 14:
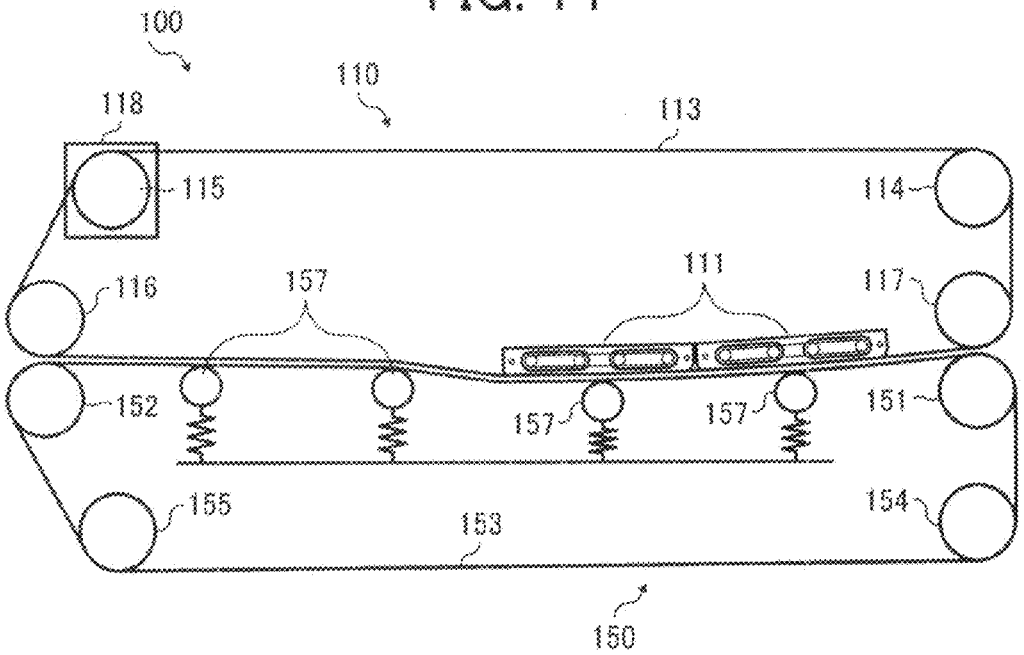
FIG. 14 is a schematic view of the cooling device including a pressure roller.

FIGS. 13 and 14 show another example of a tension adjustor of the upper transport belt 113 according to a change in the number of cooling members 111 included.

As another means for adjusting the slack of the upper transport belt 113, the position of at least one of the extending rollers that extend the upper transport belt 113 and the lower transport belt 153 is changeable, in accordance with the number of the cooling members ill.

For example, as shown in FIG. 13, changing the position of the extending rollers 119 and 156 adjusts the tension of the upper transport belt 113 and the lower transport belt 153. Also as shown in FIG. 14, a plurality of pressure rollers 157 assist in adjusting the cooling members 111, the upper transport belt 113, the lower transport belt 153, and the sheet P when passing between the upper transport belt 113 and the lower transport belt 153. In addition, the plurality of pressure rollers 157 may adjust the tension of the upper transport belt 113 and the lower transport belt 153.

Configuration Example 4

FIG. 15 shows a change in the liquid flow path due to a change in the number of liquid-cooling members 134.

According to configuration example 4, the liquid coolant flows inside of liquid-cooling member 134 to connect liquid-cooling member 134 to the liquid-flow-path converter 135 with a valve inside.

Figure 15B:
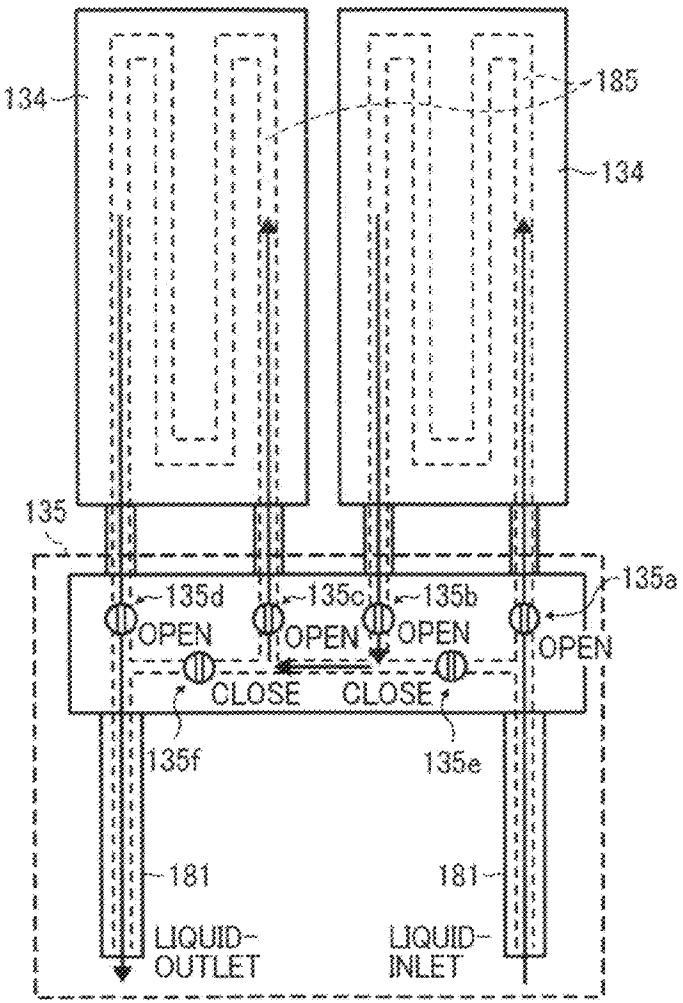
FIGS. 15A and 15B are schematic views of the liquid flow path converter.
Figure 15A:
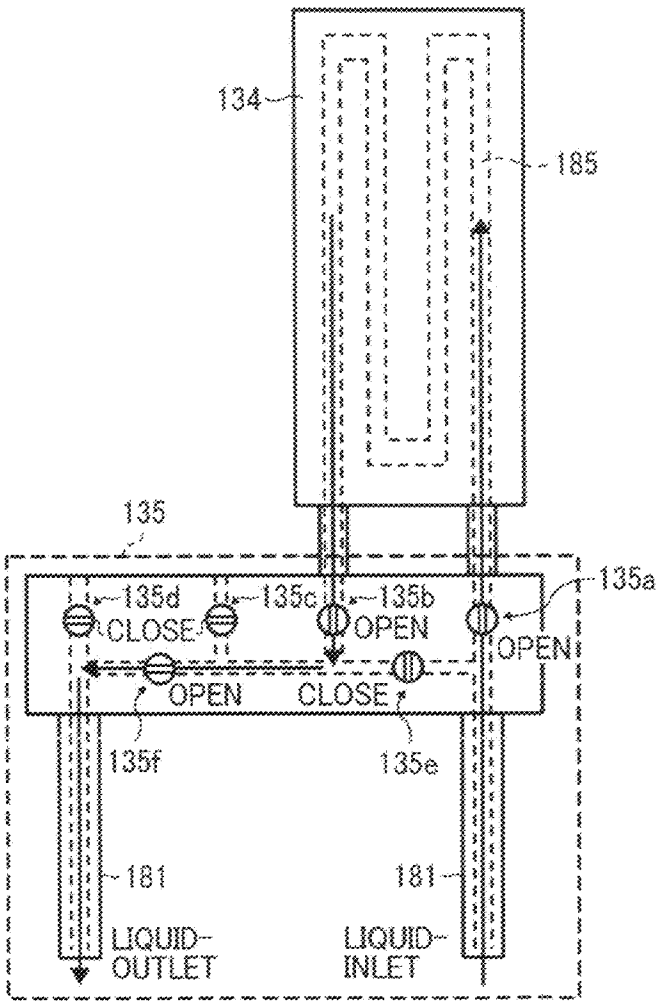

For example, as shown in FIG. 15A, the internal flow path of the liquid-flow-path converter 135 closes all valves except the liquid outlet direction because there is only one liquid-cooling member 134 connected to the liquid-flow-path.

Therefore, valves 135*a*, 135*b*, and 135*f* are open, and valves 135*c*, 135*d*, and 135*e* are closed.

Alternatively, as shown in FIG. 15B, when two liquid-cooling members 134 are connected to the liquid-flow-path converter 135, the liquid coolant flows to both liquid-cooling members 134 through the liquid-flow-path converter 135 to switch between the opening and closing of the valve of the liquid-flow-path converter 135. Therefore, valves 135*a*, 135*b*, 135*c*, and 135*d* are open, and valves 135*e* and 135 fare closed.

According to these operations, the flow path of the liquid coolant is changeable in accordance with the number of the liquid-cooling members 134. With respect to attachment and detachment of the cooling members 134 against the liquid-flow-path converter 135, fluid coupling that opens and closes valves of the liquid-flow-path converter 135 linked with attaching and detaching liquid-cooling members 134, is preferable so as to prevent leakage caused by operation error.

According to the liquid-flow-path converter 135 as shown in FIG. 15, changing the number of liquid-cooling members 134 is unnecessary to replace the cooling member 134 with the rubber tube 181 connected to the radiator 182 and the liquid storing tank 184.

Figure 16B:
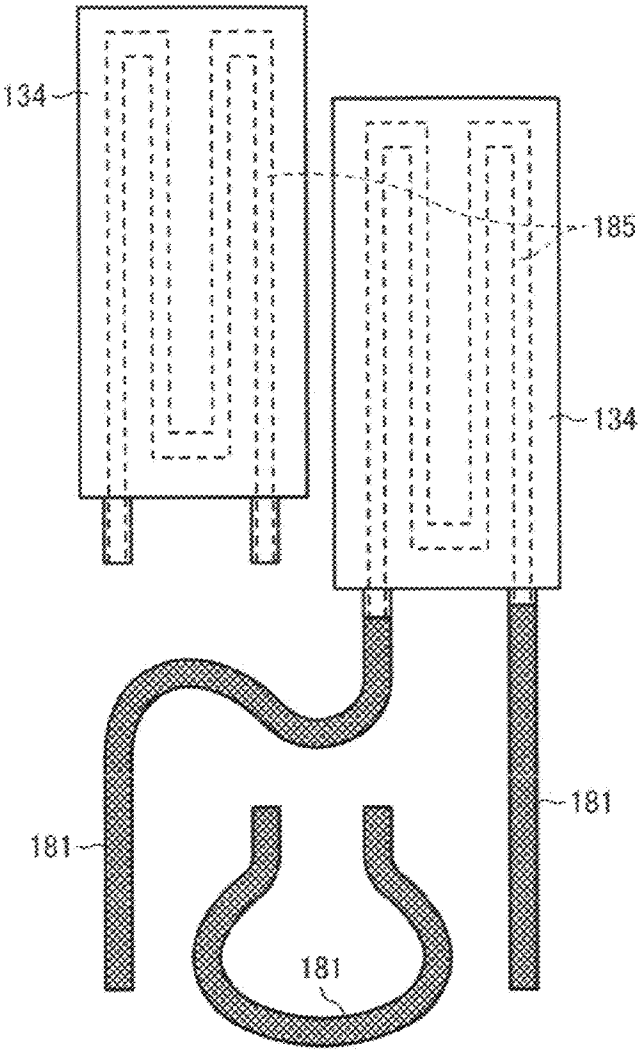
FIGS. 16A and 16B are schematic views of the changing of the cooling member attached position of the rubber tube.
Figure 16A:
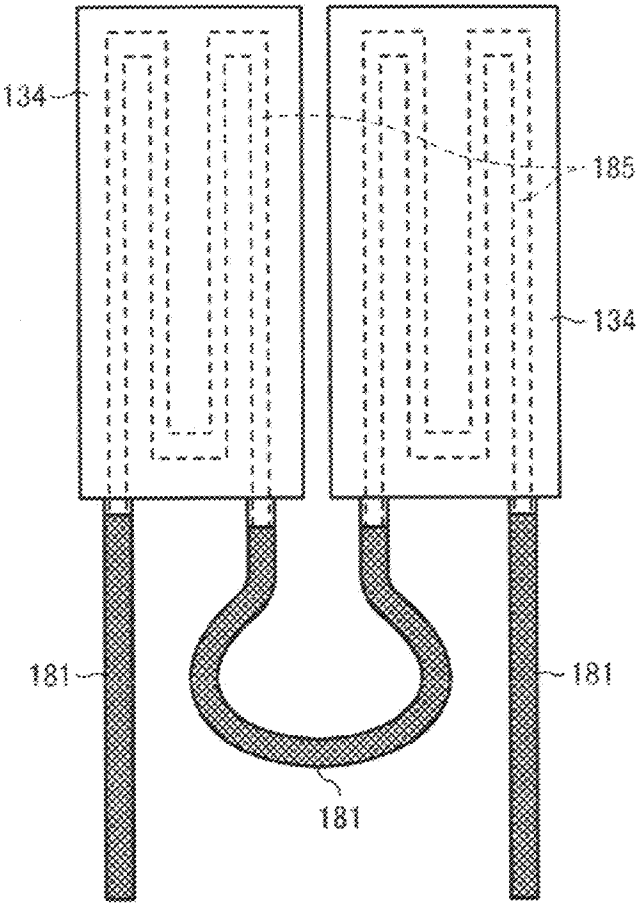
Figure 17B:
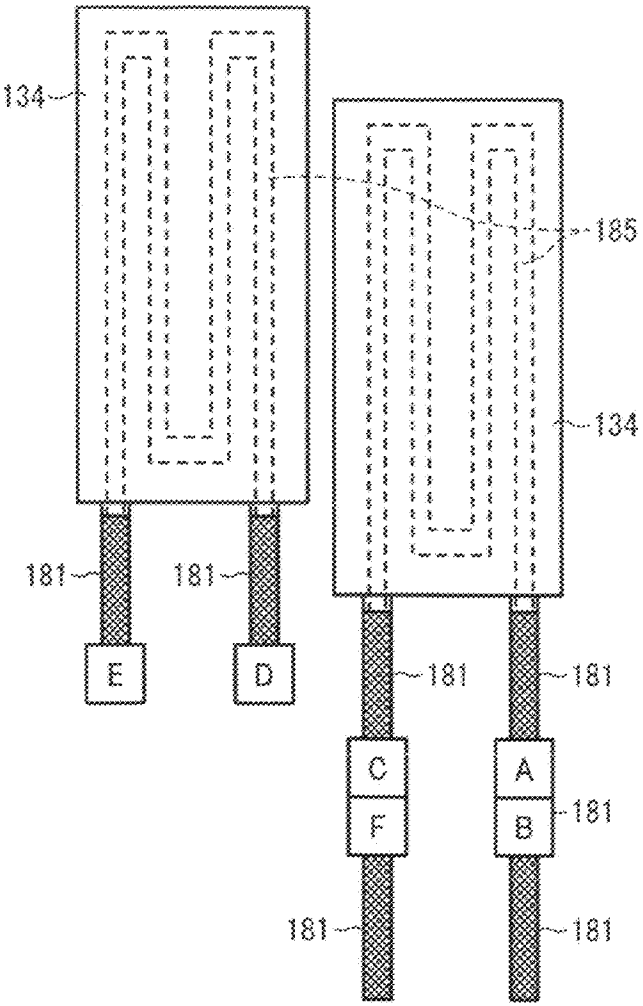
FIGS. 17A and 17B are schematic views of the changing of the flow path to replace a coupling.
Figure 17A:
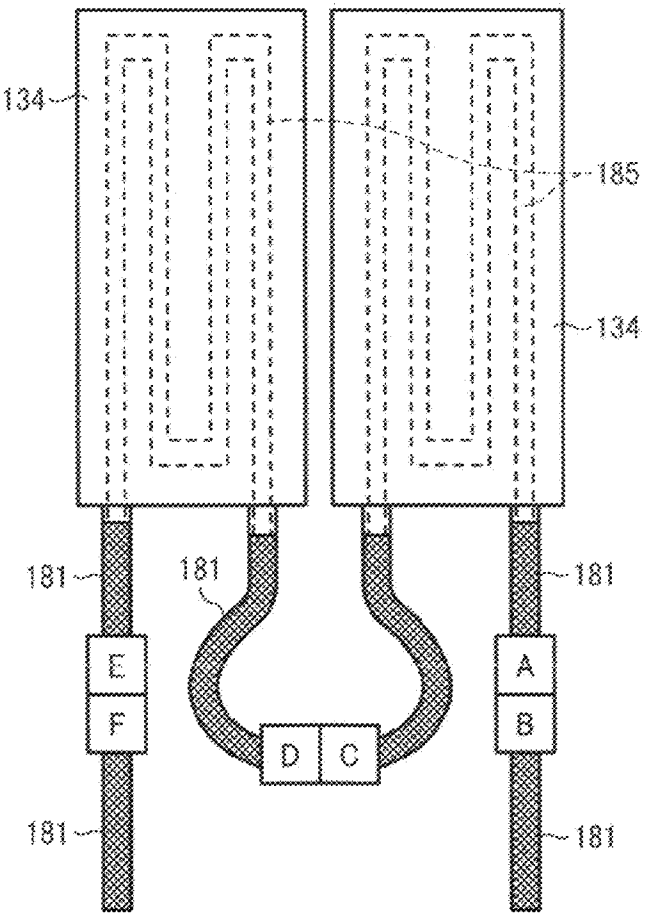

By the way, as shown in FIG. 16, the number of liquid-cooling members 134 may directly change by rearranging the rubber tubes 181. As shown in FIGS. 17A and 17B, fluid couplings (A, B, C, D, F) may be used.

Configuration Example 5

In the cooling device 100 according to configuration example 5 is different only with respect to the cooling member of the cooling device 100 of configuration examples 1 through 4. Therefore, the same members as in configuration examples 1 through 4 are attached with the same reference numbers. In addition, explanations for the same effects as in configuration examples 1 through 4 may be omitted.

Figure 18:
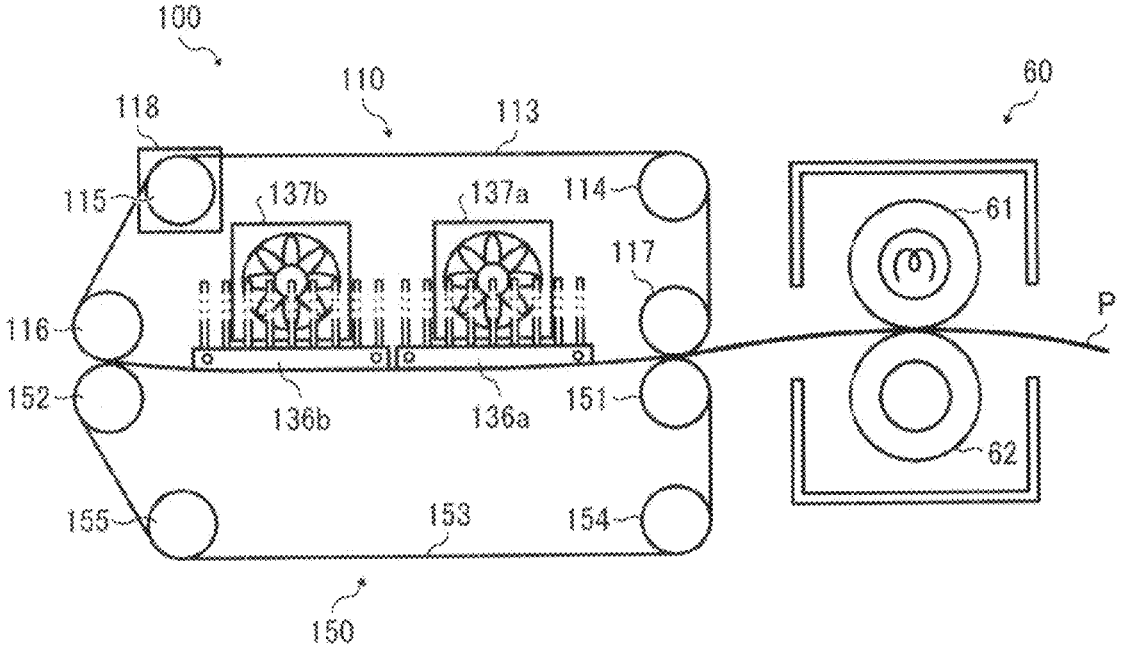
FIG. 18 is a schematic view of the cooling device including a heat sink.

As shown in FIG. 18, the cooling device 100 includes air-cooling heat sinks (136*a*, 136*b*) as the cooling member. A duct surrounds the heat sinks (136*a*, 136*b*). The fans 137*a* and 137*b*, which flow an air inside the duct, are arranged in accordance with each of the heat sinks 136*a* and 136*b*.

For example, if only the heat sink 136*a* is included and the heat sink 136*b* is removed, the fan 137*b* does not need to be driven. Therefore, in order to stop one of the fans (137*a*, 137*b*) that is arranged without a corresponding one of the heat sinks (136*a*, 136*b*), a controller turns the appropriate one of the fans (137*a*, 137*b*) on or off depending on whether the corresponding one of the heat sinks 136*a* and 136*b* is included.

Figure 19:
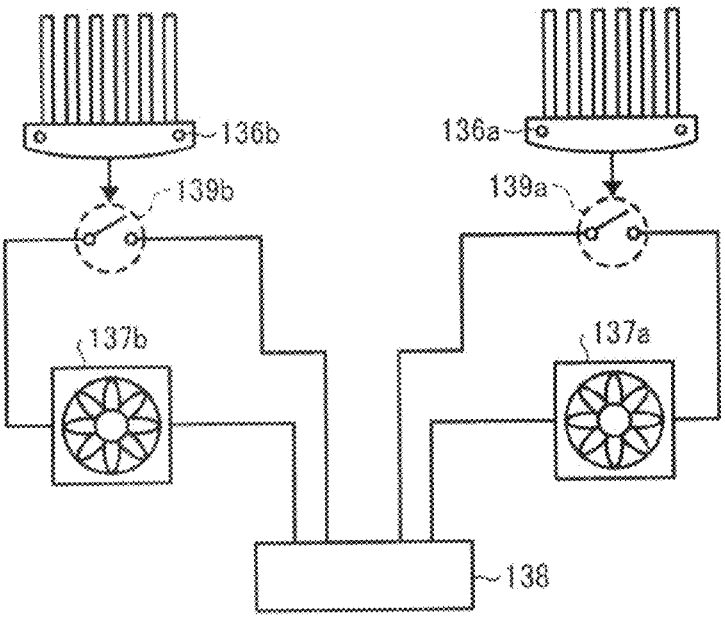
FIG. 19 is a schematic view of a controller exchange ON/OFF of the drive of the fan depending on having the heat sink or not.

For example, as shown in FIG. 19, the fan 137*a* and the fan 137*b* connected to the power equipment 138 turn OFF a respective switch 139*a* and 139*b* without the heat sink 136*a* and the heat sink 136*b*. Further, the switch 139*a* and 139*b* are pushed and turned ON when the respective heat sinks 136*a* and 136*b* are included. Also, the controller may control the ON/OFF of the output of the fan according to whether the heat sink 136*a* or the heat sink 136*b* is installed via sensors of a contact type.

In addition to this, if the heat sinks 136*a*, 136*b* and the fans 137*a*, 137*b* comprise detachable parts, for example, the cost may be reduced by removing the fan 137*b* when the heat sink 136*b* is not included.

Configuration Example 6

In the cooling device 100 according to configuration example 6, only the cooling member of the cooling device 100 differs from the configuration examples 1 through 4. Therefore, the same members as in configuration examples 1 through 4 are attached with the same reference numbers. In addition, explanations for the same effects as in configuration examples 1 through 4 may be omitted.

Figure 20:
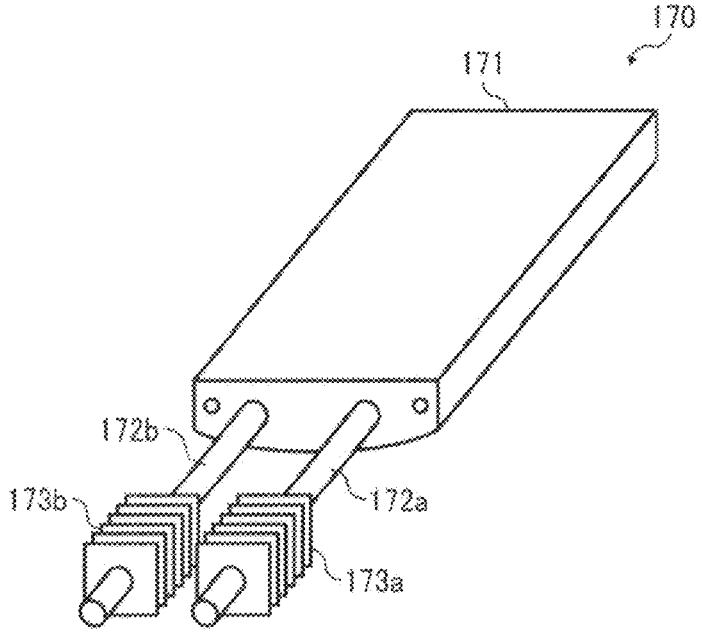
FIG. 20 is a perspective view of a heat pipe plate.

The cooling device 100 according to configuration example 6 includes at least a heat pipe plate 170 as the cooling member arranged to slide on the inside surface of the upper transport belt 113 of the upper transport portion 110, as shown in FIG. 20.

More specifically, as shown in FIG. 20, the heat pipe plate 170 comprises a plate 171, which is a plate member made of aluminum. A heat sink including two heat pipes 172*a* and 172*b* is arranged in the sheet transport direction and is built in the plate 171. At least one radiating fin 173*a*, 173*b* is arranged at the end of each of the heat pipes 172*a* and 172*b*, respectively, that protrude from the front side of the cooling device. Air-flow or free convection inside the printer 300 radiates to contact the radiating fin 173*a*, 173*b*. In example 6, blowing air from the cooling fan on the radiating fin 173*a*, 173*b* enhances the radiation effect and enhances the cooling effect due to the heat pipe plate 170.

FIG. 20 shows the heat pipes 172*a* and 172*b* that protrude from the front side of the plate 171. However, the instant invention is not intended to be limited to this configuration. The heat pipes 172*a* and 172*b* may be bent in an optional direction. Thus, bending the heat pipes 172*a* and 172*b* can arrange the radiating fin 173*a*, 173*b* located inside the printer 300 apart from the plate 171. Therefore, the printer 300 has design flexibility and can be reduced in size. In addition, arranging the radiating fin 173*a*, 173*b* near the radiator fan or near the other cooling fan can cut the costs and installation space of each of the cooling fans.

In a case where the heat sinks (136*a*, 136*b*) are installed as shown in FIG. 18, a duct needs to be installed at a location of the heat sink inside of the upper transport belt 113. However, when the heat pipe plate 170 is used as the cooling member, the radiating fin 173*a*, 173*b* radiates the heat of plate 171 to heat pipes 172*a* and 172*b*. Therefore, the duct is flexibly designed to transport the heat away from the upper transport belt 113.

Configuration Example 7

Figure 21:
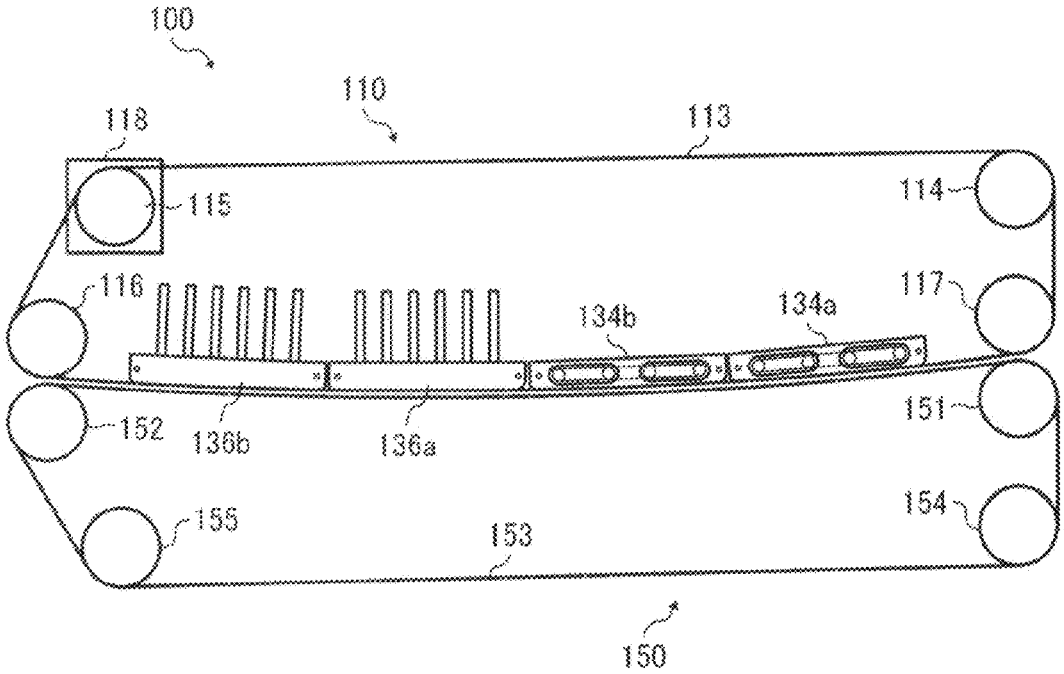
FIG. 21 is a schematic view of the cooling device including two pairs of the liquid-cooling member and the heat sink.
Figure 22:
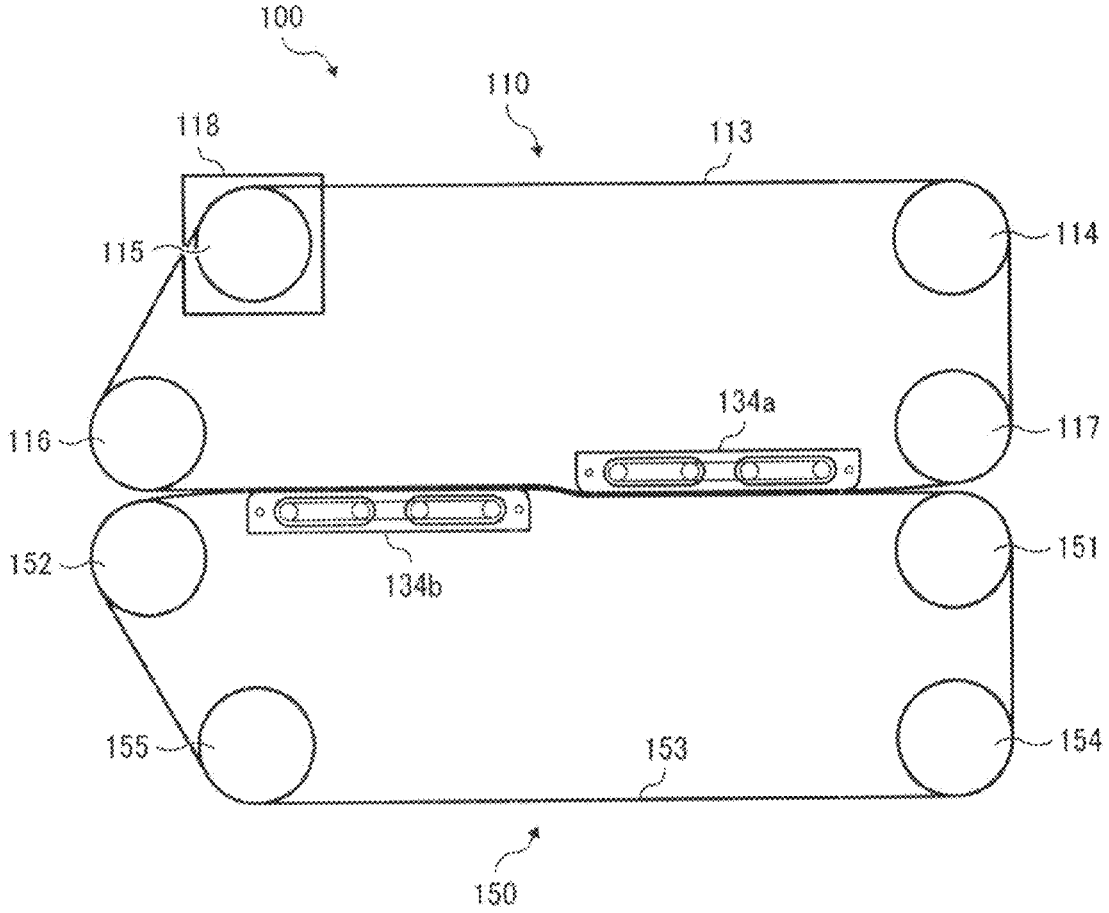
FIG. 22 is a schematic view of the cooling device including the cooling member inside the upper transport belt and the lower transport belt.

FIGS. 21 and 22 show another example of the cooling member.

The plurality of cooling members 111 installed in the cooling device 100 may use plurality of kinds of cooling members mentioned above. For example, as shown in FIG. 21, it may use a pair of the liquid-cooling members 134 and the heat sinks (136*a*, 136*b*), or the heat pipe plate 170, as shown in FIG. 20.

All of the above examples show the cooling members installed inside the upper transport belt 113, however, the cooling members may be installed inside of the lower transport belt 153. In addition, as shown in FIG. 22, a cooling member may be installed in the upper transport belt 113 and the lower transport belt 153, respectively. Numerous additional modifications and variations are possible in light of the above teachings. It is therefore to be understood that, within the scope of the appended claims, the disclosure of this patent specification may be practiced otherwise than as specifically described herein.

What is claimed is:

1. A cooling device comprising:

a rotatable first belt extended by a plurality of extenders that conveys a sheet in contact with a surface of the first belt;

a plurality of coolers to cool the sheet via the first belt, a cooling surface of each cooler contacting an internal surface of the first belt, and the cooling member being detachable; and an adjuster to adjust a contact condition of the cooling surface and the internal surface according to a number of coolers installed, wherein the adjuster is an auxiliary member having a same shape as the cooling surface, and wherein in a state where one of the plurality of the coolers has been detached, the auxiliary member fits in a position where the one of the plurality of the coolers has been detached.

2. The cooling device according to claim 1, further comprising:

a side plate to fix the cooler and the auxiliary member, the side plate including a positioning portion to locate the cooler and the auxiliary member.

3. The cooling device according to claim 1, wherein a position of at least one of the extenders is changeable, and the adjuster adjusts a tension of the belt by changing the position of the extender.

4. The cooling device according to claim 1, wherein the cooler includes a cooling medium flow path therein, and wherein the cooling device further comprises:

a radiator to radiate the cooling medium;

a tube to circulate the cooling medium between the cooler and the radiator; and a conveying member to convey the cooling medium inside the tube.

5. The cooling device according to claim 4, further comprising:

a cooling medium flow path converter to convert the cooling medium flow path in accordance with a detached cooler.

6. The cooling device according to claim 1, wherein the plurality of coolers each include an air-cooling heat sink.

7. The cooling device according to claim 1, wherein the plurality of coolers each include a heat pipe plate including a heat pipe.

8. The cooling device according to claim 1, wherein the adjuster is disposed at different position than a position of the cooler.

9. The cooling device according to claim 1, further comprising:

a second belt extended by a plurality of second extenders, the second belt and the first belt facing each other; and a nip between the second belt and the first belt through which the sheet is transferred.

10. The cooling device according to claim 9, wherein the plurality of coolers are installed on only the first belt, and the adjuster is installed on at least one of the first belt and the second belt.

11. An image forming apparatus comprising:

a cooling device according to claim 1;

a transfer device to transfer a toner image onto the sheet; and a fixing device to fix toner on the sheet, wherein the cooling device cools the sheet having toner fixed thereon.

12. A cooling device comprising:

a rotatable first belt extended by a plurality of extenders that conveys a sheet in contact with a surface of the first belt;

a plurality of coolers to cool the sheet via the first belt, a cooling surface of each cooler contacting an internal surface of the first belt, and the cooler being detachable;

an adjuster to adjust a contact condition of the cooling surface and the internal surface according to a number of coolers installed;

wherein each of the coolers is an air-cooled heat sink;

a fan to blow the cooler; and a switch to control a state of the fan depending on whether at least one air cooled heat sink is installed.

13. The cooling device according to claim 12, further comprising:

a second belt extended by a plurality of second extenders, the second belt and the first belt facing each other; and a nip between the second belt and the first belt through which the sheet is transferred.

14. The cooling device according to claim 13, wherein the plurality of coolers are installed on only the first belt, and the adjuster is installed on at least one of the first belt and the second belt.

15. An image forming apparatus comprising:

a cooling device according to claim 12;

a transfer device to transfer a toner image onto the sheet; and a fixing device to fix toner on the sheet, wherein the cooling device cools the sheet having toner fixed thereon.

16. A cooling device comprising:

a rotatable first belt extended by a plurality of extenders that conveys a sheet in contact with a surface of the first belt;

a plurality of coolers to cool the sheet via the first belt, a cooling surface of each cooler contacting an internal surface of the first belt, and the cooling member being detachable; and an adjuster to adjust a contact condition of the cooling surface and the internal surface according to a number of coolers installed, wherein the cooler includes a cooling medium flow path therein, and wherein the cooling device further comprises:

a radiator to radiate the cooling medium;

a tube to circulate the cooling medium between the cooler and the radiator; and a conveying member to convey the cooling medium inside the tube.

17. The cooling device according to claim 16, wherein the adjuster is an auxiliary member having a same shape as the cooling surface, and wherein in a state where one of the plurality of the coolers has been detached, the auxiliary member fits in a position where the one of the plurality of the coolers has been detached.

18. The cooling device according to claim 17, further comprising:

a side plate to fix the cooler and the auxiliary member, the side plate including a positioning portion to locate the cooler and the auxiliary member.

19. The cooling device according to claim 17, wherein a position of at least one of the extenders is changeable, and the adjuster adjusts a tension of the belt by changing the position of the at least one of the extenders.

20. An image forming apparatus comprising:

a cooling device according to claim 17;

a transfer device to transfer a toner image onto the sheet; and a fixing device to fix toner on the sheet, wherein the cooling device cools the sheet having toner fixed thereon.

* * * * *